US005788423A

United States Patent [19]

Perkins

[11] Patent Number: 5,788,423

[45] Date of Patent: Aug. 4, 1998

[54] MASONRY BLOCK RETAINING WALL WITH ATTACHED KEYLOCK FACING PANELS AND METHOD OF CONSTRUCTING THE SAME

[75] Inventor: Garry R. Perkins, Rolling Meadows, Ill.

[73] Assignee: G.P. Industries, Inc., Schaumburg, Ill.

[21] Appl. No.: 524,202

[22] Filed: Aug. 9, 1995

[51] Int. Cl.[6] ..... E02D 17/18; E02D 29/02; E04C 1/40

[52] U.S. Cl. ..... 405/284; 405/286; 52/604; 52/612

[58] Field of Search ..... 405/284, 286; 52/570, 426, 599, 604, 605, 606, 612, 311.1

[56] References Cited

U.S. PATENT DOCUMENTS

| | | | |
|---|---|---|---|
| Re. 34,314 | 7/1993 | Forsberg | 52/562 |
| D. 299,067 | 12/1988 | Forsberg | D25/582 |
| D. 317,048 | 5/1991 | Forsberg | D24/114 |
| 3,632,725 | 1/1972 | Jones | 264/256 |
| 3,877,236 | 4/1975 | O'Neill et al. | 405/273 |
| 4,478,021 | 10/1984 | Person | 52/612 X |
| 4,619,560 | 10/1986 | Crinnion et al. | 405/284 |
| 4,802,320 | 2/1989 | Forsberg | 52/585 |
| 4,825,619 | 5/1989 | Frosberg | 52/562 |
| 5,174,688 | 12/1992 | Meheen | 405/284 |
| 5,350,256 | 9/1994 | Hammer | 405/286 |
| 5,457,926 | 10/1995 | Jensen | 52/604 |
| 5,551,809 | 9/1996 | Forsberg | 405/285 |
| 5,598,679 | 2/1997 | Orton et al. | 405/284 X |
| 5,622,456 | 4/1997 | Risi et al. | 52/604 X |
| 5,636,938 | 6/1997 | Ragazzo | 405/15 |

*Primary Examiner*—Tamara L. Graysay
*Assistant Examiner*—Tara L. Mayo
*Attorney, Agent, or Firm*—Fitch, Even, Tabin & Flannery

[57] ABSTRACT

An inexpensive, yet beautiful retaining wall may be formed with architecturally pleasing, coordinating or matching materials such as marble, granite or the like. Architecturally pleasing, thin decorative facing panels are attached to masonry blocks. The retaining wall is formed from several rows of such masonry blocks with the blocks each including a top edge and a bottom edge and a front face having a masonry appearance extending between the top and bottom edges. The blocks in an upper row are stacked upon the blocks in an adjacent lower row below the upper row, with the bottom edges of the upper row blocks supported on adjacent lower row blocks. Decorative facing panels are provided which are substantially smaller in size than the masonry blocks and include a rear face attached to the front face of the masonry blocks to change the outward appearance of the front faces of the masonry blocks. A keyway and key are formed in the front faces of the blocks and rear faces of the decorative facing panels for mounting the decorative facing panels flush against the front faces of the blocks.

14 Claims, 8 Drawing Sheets

Fig. 3
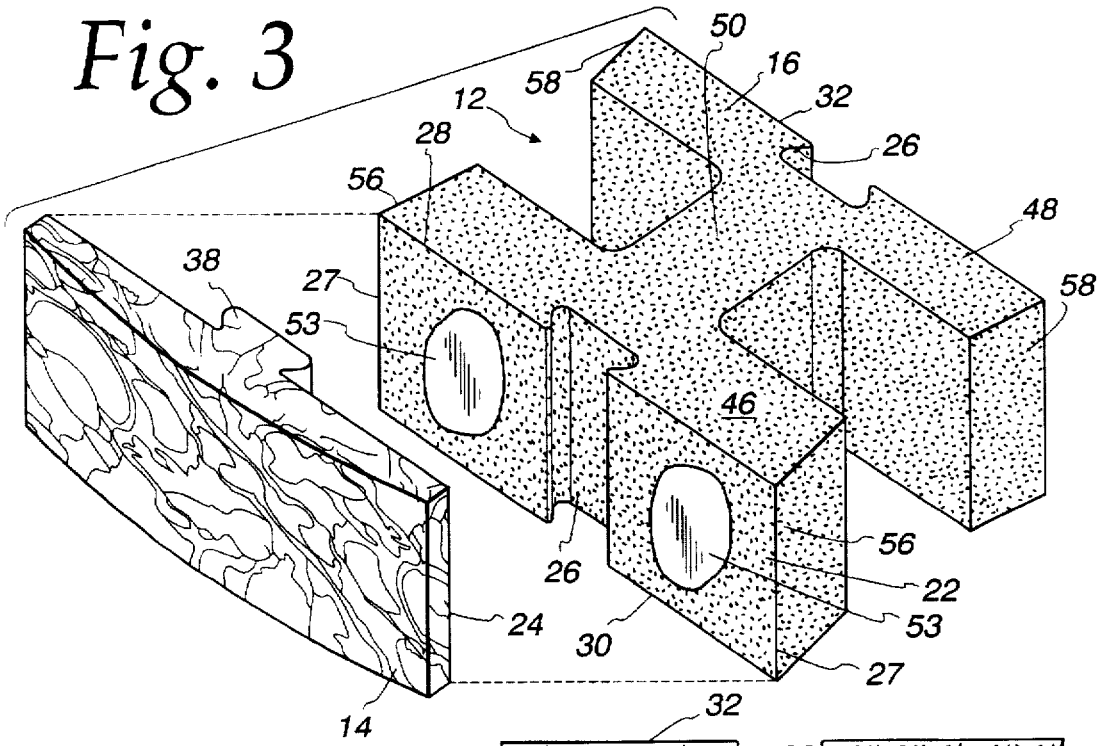
Fig. 4
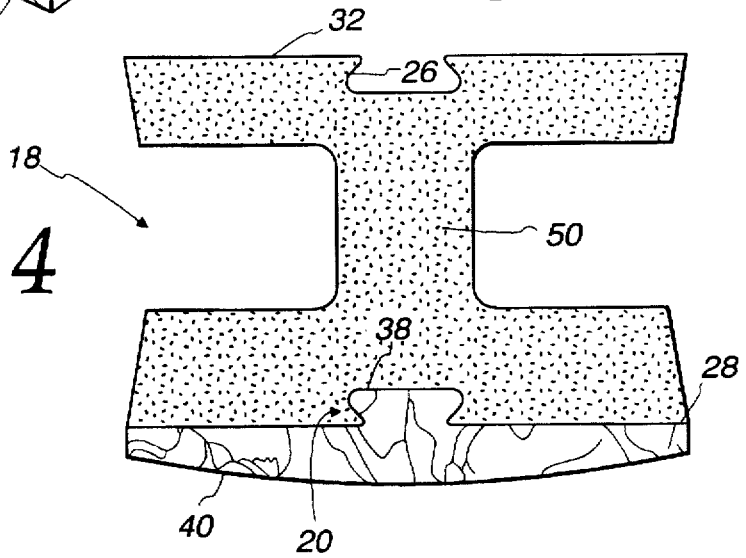
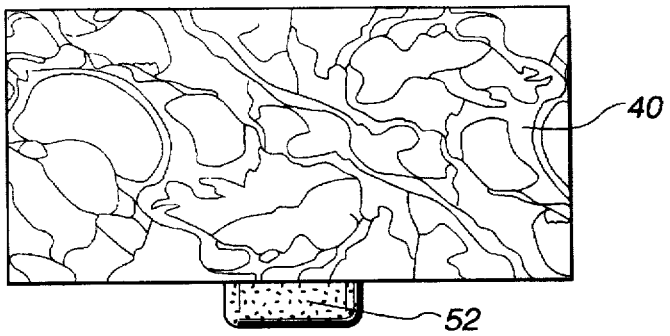
Fig. 5

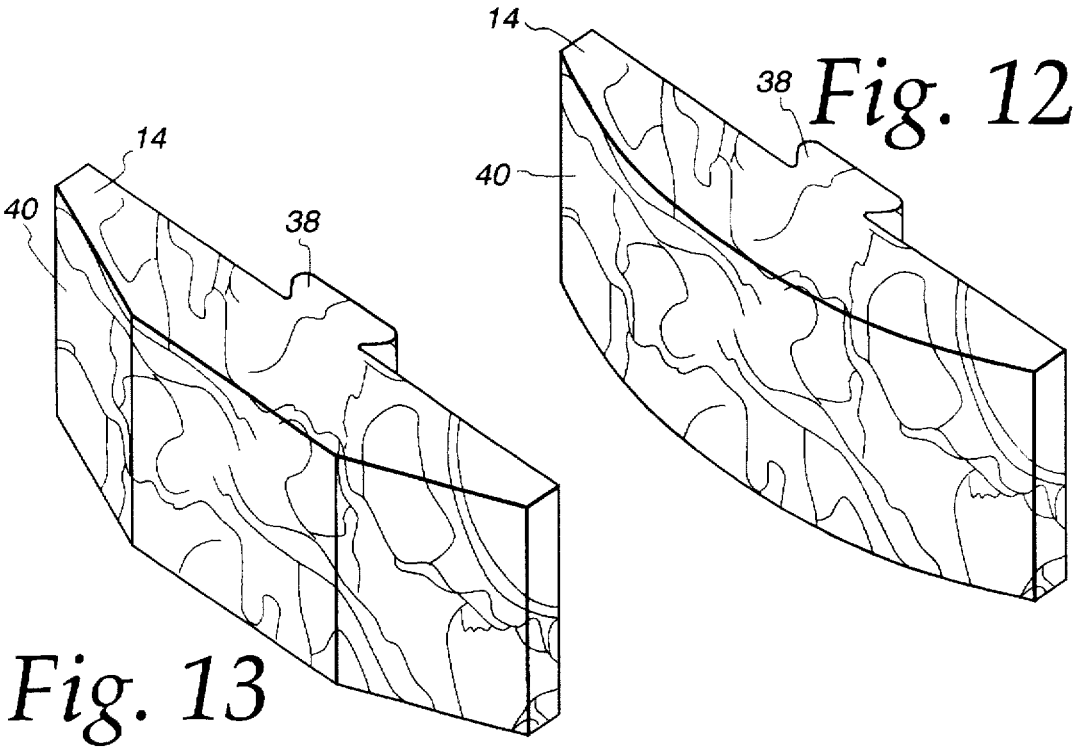
Fig. 12
Fig. 13
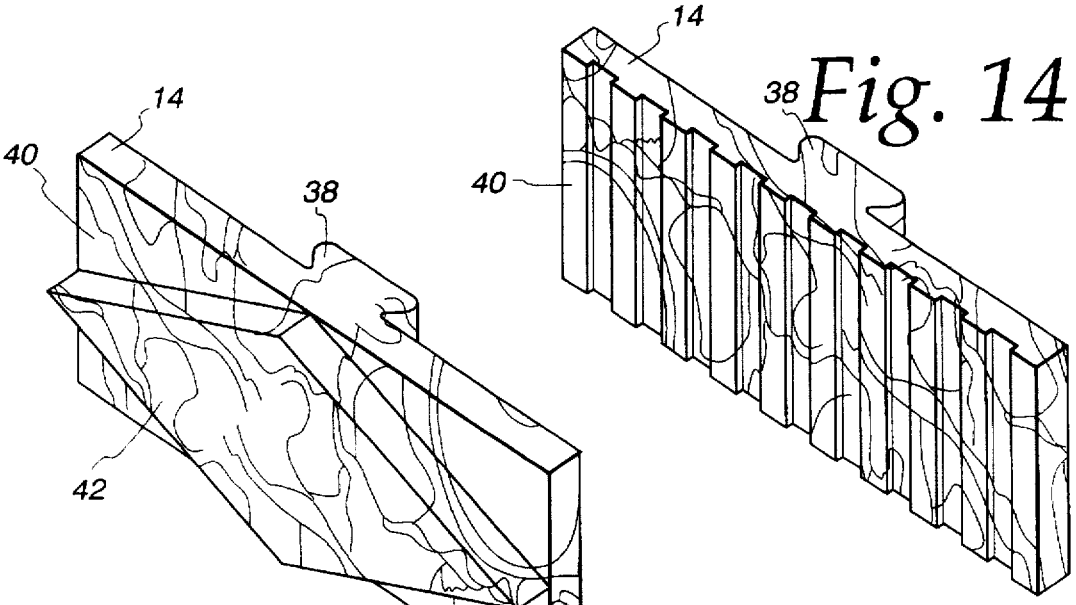
Fig. 14
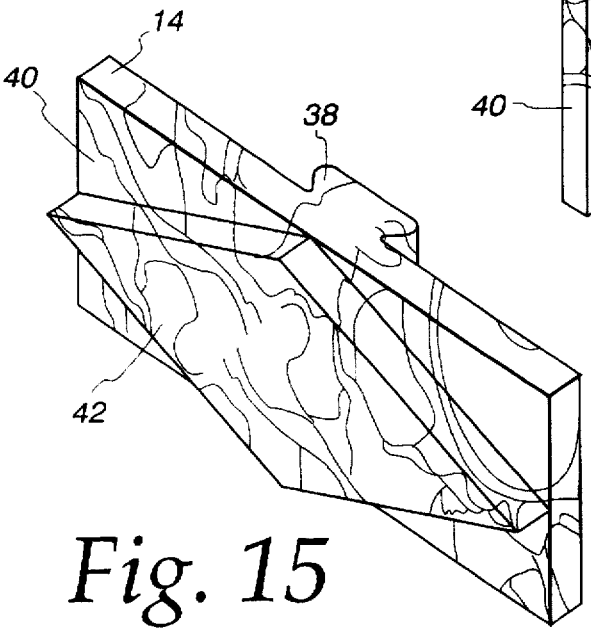
Fig. 15

Fig. 16
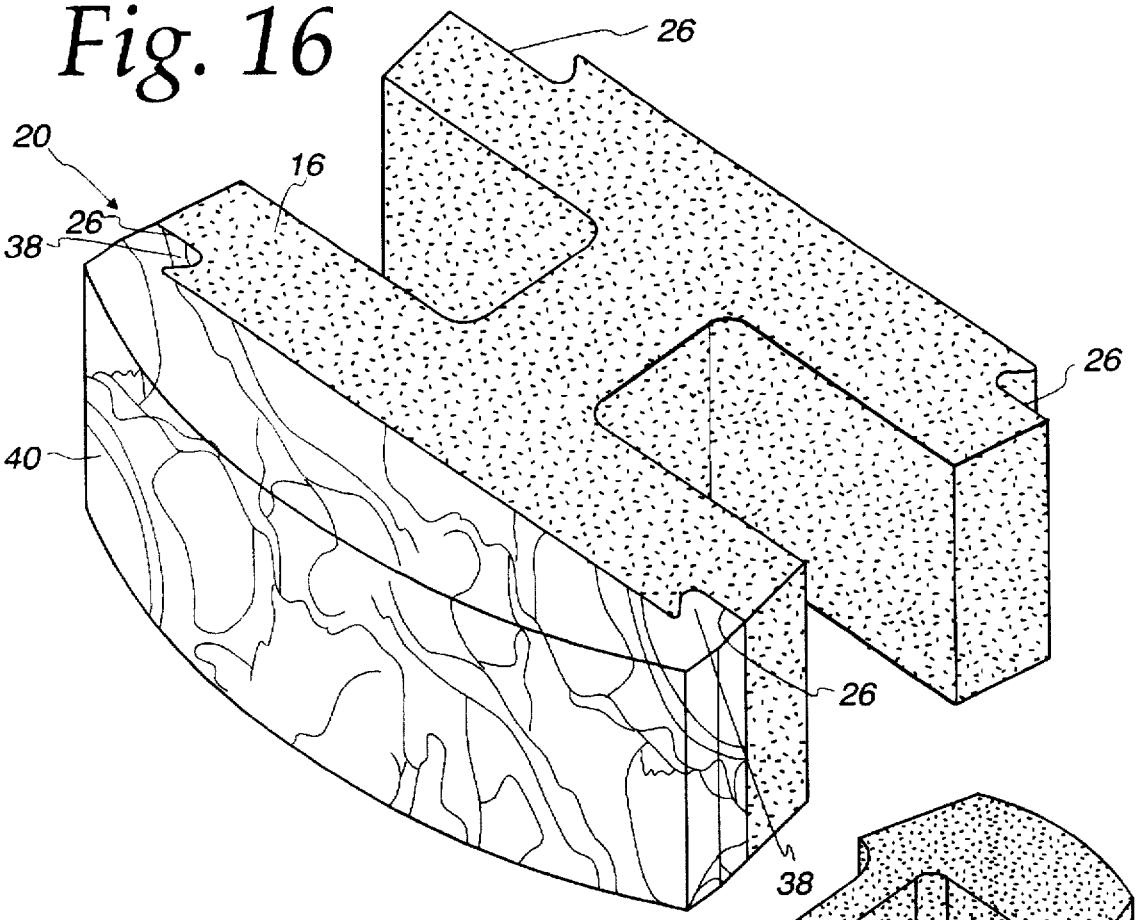
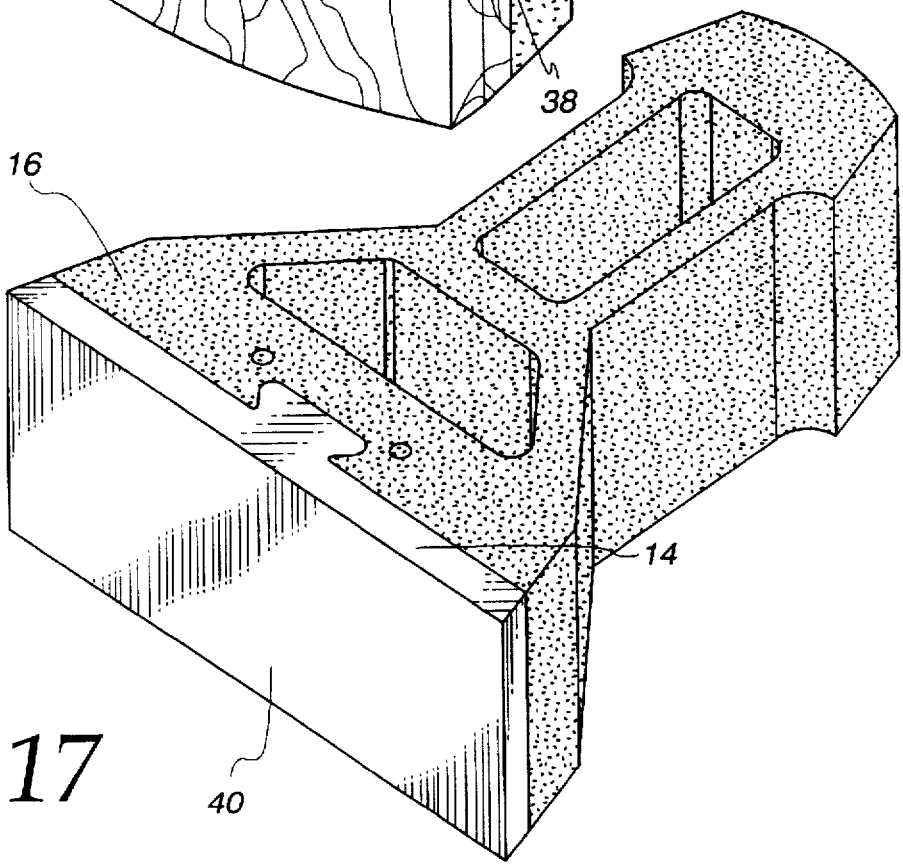
Fig. 17

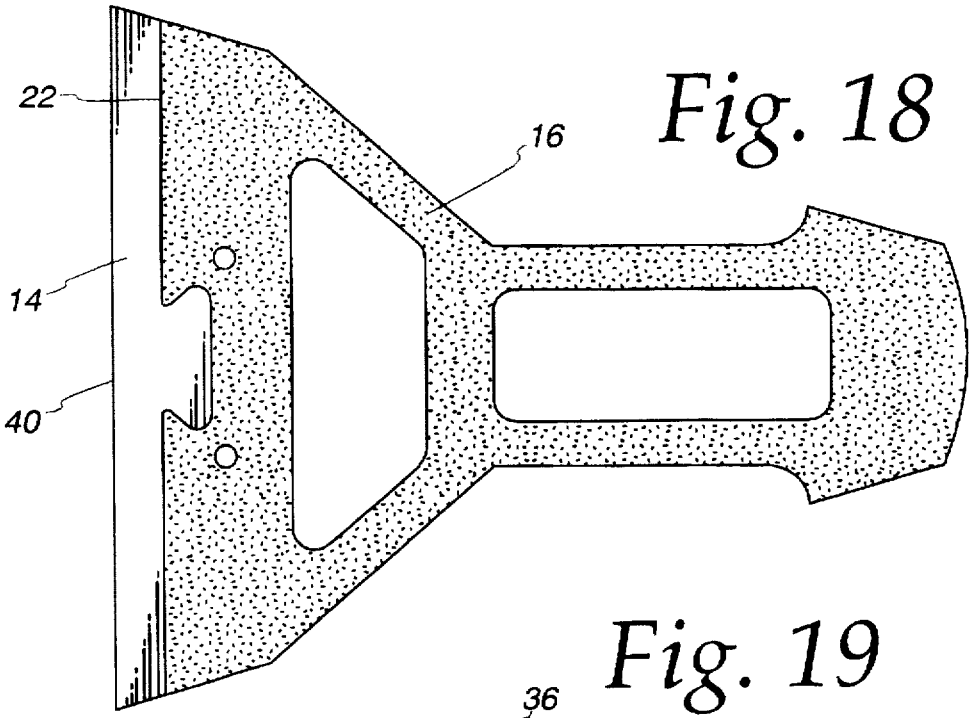
Fig. 18
Fig. 19
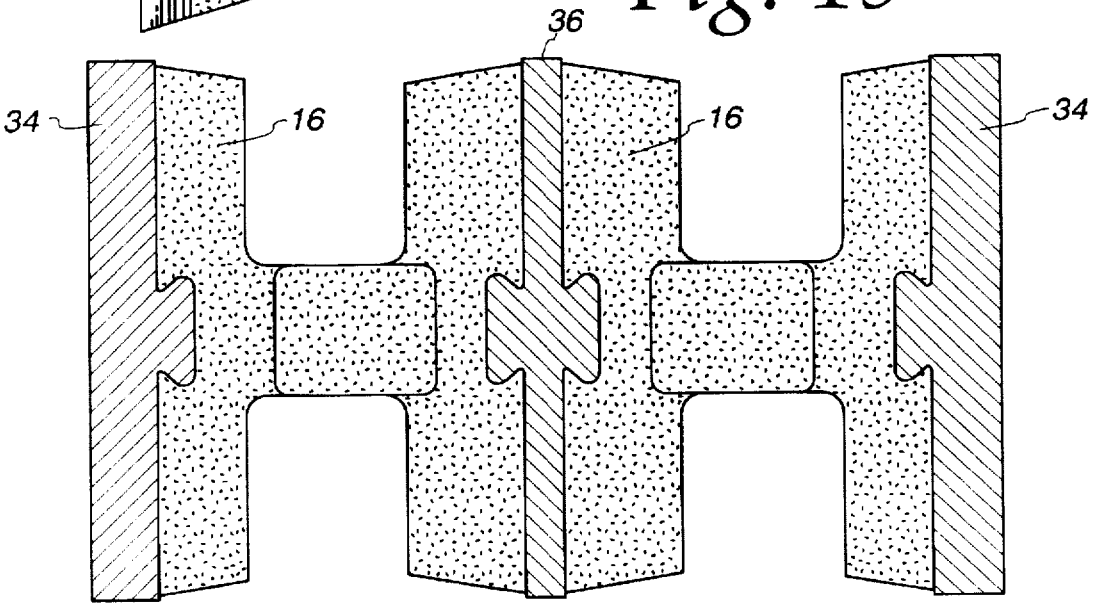
Fig. 20
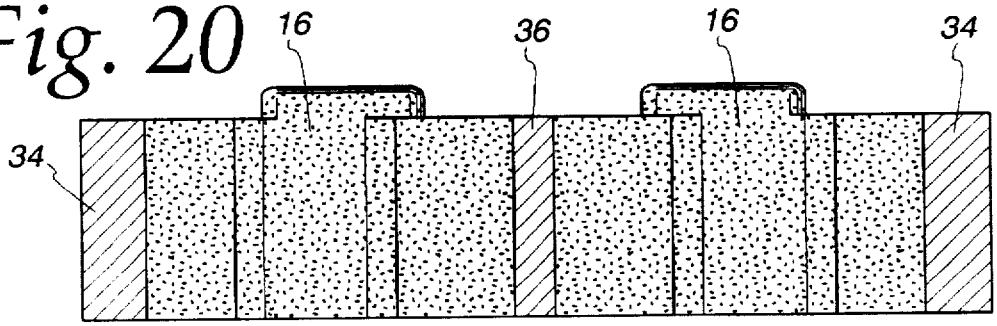

MASONRY BLOCK RETAINING WALL WITH ATTACHED KEYLOCK FACING PANELS AND METHOD OF CONSTRUCTING THE SAME

FIELD OF THE INVENTION

The present invention relates to retaining walls and, more particularly, to retaining walls made from masonry blocks having facing panels attached thereto.

BACKGROUND OF THE INVENTION

There are a wide variety of exterior beautiful wall materials such as marble, granite, black or colored glass, tile, polished metal, stainless steel, copper or gold colored metal sheets, anodized metals, etc. which cover the outer sides of buildings. These building facing materials are generally quite expensive and usually in the shape of flat sheets which are relatively thin in cross-section. Often beautiful terrazzo or fancy tile walkways surround or lead to such buildings and are of a matching material or are color coordinated to tie them architecturally to the building. Elaborate landscape plantings are often combined with and enhance the beauty of the structure and its setting. Generally though, any retaining walls or waterway walls around such buildings are made of masonry or concrete materials, probably because the blocks are so heavy and deep in cross-section that it would be prohibitively expensive to make the retaining walls of a matching material, e.g., a marble or stainless material retaining block. Typically, the retaining wall block is quite thick and deep in the shape of a large block; whereas, the typical architectural building wall facing panel is a large, thin flat sheet. Thus, to form an architectural wall of large thick blocks of marble, stainless steel, etc. is too expensive and is not done, except maybe in a rare instance. The heavy block weight and large block depth are needed to provide a stable stack of blocks one upon another to build a high self-supporting wall which also is used to retain soil behind it. Thus, there is a need for a less expensive architectural matching retaining wall that can match the beauty of building and walkways about the building.

Masonry blocks for retaining walls typically are cast in metal molds to form a unitary block body with the mold defining the shape of the masonry block body. The retaining walls may be formed by lining the blocks in a row on compacted road mix spread on soil therebelow. The wall is built to its desired height by simply stacking rows of blocks on the row immediately therebelow. When used to retain soil, the wall can be spaced forwardly from the soil to be retained with the space between the wall and soil filled by a volume of open-grade clear stone. In this manner, the retaining wall is not in contact with the soil it retains and, as such, is not subject to damage, e.g., water damage, which such contact can cause. To provide for run-off to avoid damaging the base of the wall, a drain tile can be provided near the bottom of the stone.

A retaining wall which is erected as described above has an outward appearance defined by the forward, outwardly-facing sides of the blocks, and as such, usually has a masonry appearance as the block face is formed from the same material as the body of the blocks. While it is possible to change the outward form of the retaining wall, for example, by altering the mold shape in which the masonry blocks are formed, the wall is restricted in its appearance by the material with which the blocks are formed. Another known manner for changing the outward form of blocks involves simultaneously forming a pair of mirror-image blocks in a single mold so that they are joined in the mold. After forming the pair of blocks in the mold, the attached pair of blocks are then split in half at their joined faces to expose the previously attached faces such that a roughened surface appearance is produced. However, it is desirable for retaining walls to be able to provide an outward appearance that is different from the appearance of the low cost material by which the block body is generally formed, usually to the appearance provided by a more expensive material, such as marble, without incurring the higher costs associated with making the entire block body from these more expensive materials. In this manner, the outward appearance of retaining walls can be economically matched to the materials from which surrounding structures are built, such as buildings and homes. It is also desirable to provide retaining walls which can have their appearance quickly and easily changed in the field in case of damage or changes in desired appearance.

SUMMARY OF THE INVENTION

In accordance with the present invention, an architectural retaining wall with a decorative face of marble, granite, colored glass, metal or the like is produced inexpensively so that it can be used to match, coordinate or otherwise compliment a building or walkway material. More specifically, beautiful retaining walls are formed from a plurality of rows of masonry blocks having thin, decorative, architectural facing panels substantially smaller in size than masonry blocks are attached to the masonry or concrete blocks to change the outward appearance of the front faces of the masonry blocks to conform to the architect's overall use of similar or matching colors and/or materials. A locking system is provided which allows the decorative facing panels to be securely attached to the block bodies in a quick and easy manner in the field. Such a locking system must hold the facing panels securely against thawing, freezing, changes in temperature and shifting of blocks.

The above decorative retaining wall blocks provide a great deal of flexibility in design with the ability to match retaining walls made thereof to a wide variety of building exteriors at a very low cost as compared to having to make the full retaining wall block of the exterior building material, such as expensive marble, granite, aluminum or bronze.

Preferably, the locking system includes a keyway formed in the front faces of the blocks and a key formed on the rear faces of the decorative facing panels such that a decorative facing panel can be slidably mounted onto each of the masonry block bodies. To build retaining walls with the decorative blocks, the blocks are stacked such that the lower edge of an upper block rests on an adjacent lower row block to produce a set back from one row of blocks to the next. In this manner, the decorative facing panels will be attached to an upper block by sliding its key into a keyway of an upper block body so that the facing panel will rest on and be supported by block units in a lower offset row each including a similarly attached block body and facing panel with the upper facing panel being prevented from sliding downwardly as it rests on the row of blocks immediately therebelow. To further secure the decorative facing panels to the blocks, an adhesive can be applied between the blocks and facing panels which when cured bonds the facing to the masonry block.

Where the retaining wall block is fairly long, such as 36" wide rather than the normal 16" wide block, the blocks can be provided with multiple keyways for receipt of corresponding keys on decorative facing panels. Further, the blocks can have a keyway formed in their back face for mounting facing panels flush against the back faces of the blocks such as may be desirable for designing retaining walls for buildings, homes and the like where both sides of the wall may be visible.

In one form, the blocks can include tabs protruding from the bottom thereof and with the blocks being configured to form openings between adjacent blocks in a row. With the tabs of upper blocks inserted into the openings between adjacent lower blocks, the tabs and openings cooperate to substantially fix the stacked blocks and adjacent upper lower rows in offset relation to each other. In this manner, a wall can be formed having a uniform set back from one row to the next. Further, this assists in ensuring that the decorative facing panels rest on blocks immediately therebelow so as not to slide downwardly out of the keylock arrangement with its corresponding block body.

Preferably, the keys or locating members on the decorative facing panels and the keyways on the blocks have complementary cross-sectional shapes, such as a trapezoidal shape, to mount the facing panels flush against their corresponding block bodies with the locating members matingly inserted in the keyways. Manifestly, the shape of the complementary keyway and key can be varied while still falling within the purview of the present invention.

In another form, more than one decorative facing panel can be attached to one block body to produce a different decorative design, and with different types of panels, various combinations of designs and/or colors.

As previously mentioned, the block bodies can be made from a low-cost masonry material while the smaller decorative facing panels can be made from more expensive materials such as a marble or granite, or a metallic material such as copper or aluminum. With the smaller decorative facing panels, the panels can be economically made from more expensive materials to match retaining walls to commercial or industrial or even residential buildings.

Also, it will be apparent that the decorative facing panels can be attached to a wide variety of differently-shaped masonry block bodies with the facing panels and block bodies provided with the aforesaid keyway interlock.

In a preferred embodiment, the block body can have an H-shape in cross-section defined by a pair of elongate spaced legs spanned by an intermediate web with the forward block face and keyway interlock formed on at least one of the spaced legs. When forming the retaining wall, the blocks in a row are placed in abutting relation to one another by aligning the ends of their legs against each other such that the leg including the block face and keyway interlock is facing forwardly. With the blocks so arranged, adjacent blocks will form an opening defined by portions of their abutting legs and by their webs which can receive a tab formed on the bottom of the web and protruding forwardly underneath the forward leg such that with the blocks stacked in rows the tabs will uniformly set back the blocks in one row from the row therebelow. Thereafter, the facing panels can be slidingly mounted in the keyways so that their rear faces are flush against the front faces of the blocks with the panels being supported by the blocks therebelow.

BRIEF DESCRIPTION OF THE DRAWINGS

FIG. 3 is an exploded perspective view of a single block and decorative facing panel utilized in the wall of FIG. 1;

FIG. 4 is a plan view of the block and facing panel of FIG. 3;

FIG. 5 is a front elevational view of the block of FIG. 3 showing a tab projecting from the bottom of the block;

FIG. 12 is a perspective view of a first alternate embodiment of the decorative facing panel according to the present invention;

FIG. 13 is a second alternative embodiment of the decorative facing panel according to the present invention;

FIG. 14 is a third alternative embodiment of the decorative facing panel according to the present invention;

FIG. 15 is a fourth alternative embodiment of the decorative facing panel according to the present invention;

FIG. 16 is a perspective view of a fifth alternative embodiment of the decorative facing panel with a block body as illustrated in FIG. 3 adapted to be attached to the decorative facing panel;

FIG. 17 is a facing panel similar to that illustrated in FIGS. 1–8 used with an alternative block body;

FIG. 18 is a plan view of the panel and block body of FIG. 17;

FIG. 19 is a plan view of a pair of block bodies as formed in the mold having metal mold inserts;

FIG. 20 is an elevational view of the pair of block bodies of FIG. 19; and

DETAILED DESCRIPTION OF THE PREFERRED EMBODIMENTS

Figure 1:
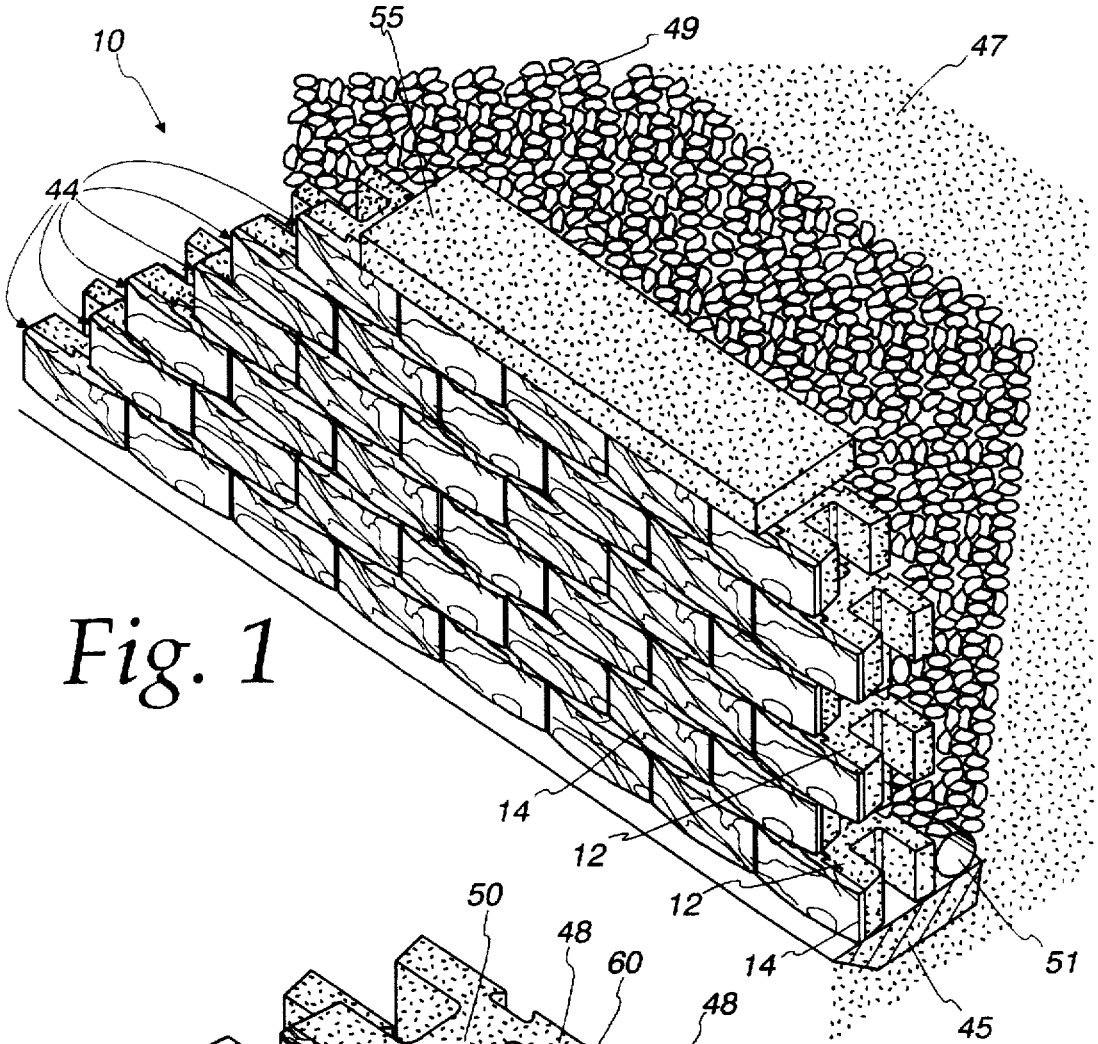
FIG. 1 is a perspective view of a retaining wall formed by rows of blocks having decorative facing panels attached thereto.

In FIG. 1, a retaining wall 10 is illustrated which is constructed from the masonry blocks 12 and decorative facing panels 14 of the present invention. As can be seen in FIG. 1, the decorative facing panels 14 provide the retaining wall 10 with an outward appearance that is different from the appearance of the masonry blocks 12 without the facing panels 14. In this manner, large block bodies 16 can be cast or molded from a low cost masonry or concrete material while using more expensive materials, such as marble or granite or even metallic materials, such as copper or aluminum, for the smaller decorative facing panels 14. This is of particular value to retaining wall designers such as engineers and landscape architects as attractive retaining walls can be economically built which match commercial, industrial or even residential buildings. This provides virtually unlimited flexibility in design in that the designers have the ability to match retaining walls to almost any building exterior at a relatively low cost as opposed to having to make the full retaining wall blocks of the more expensive decorative facing panel material. Further, the blocks 12 and facing panels 14 of the present invention allow engineers designing and building large highway retaining walls and waterway walls and the like to form such walls with a more aesthetically pleasing outward appearance than was previously economical.

To attach the decorative facing panel 14 to the block body 16 to form block units 18 for use in decorative retaining walls 10, interengaging female and male structure for removably attaching the facing panels 14 to the block body 16 is provided in the form of a keyway interlock system 20. Referring to FIG. 3, the block body 16 includes a front face 22 and the facing panel 14 includes a rear face 24 with the keyway interlock system 20 including a first portion on the front face 22 of the block body 16 and a second portion of the keyway interlock system 20 on the rear face 24 of the decorative facing panels 14. More specifically, the block bodies 16 each include an elongate keyway 26 formed in the block body front face 22 intermediate of its outer side edges 27. The keyway 26 extends vertically from a top edge 28 to a bottom edge 30 of the block body front face 22. Typically, a block body 16 will be approximately 16" wide as measured across its front face 22 between side edges 27. However, the block body 16 can be wider, such as for example 36", wherein multiple keyways 26 may be desirable for attaching facing panels 14 thereto. In this instance, the keyways 26 can be formed at the outer edges of the front face 22, as is illustrated in FIG. 16. Typically, retaining wall blocks weigh 60 to 80 lbs. or more and have a depth of twelve inches or more and a height of eight inches or more.

In the illustrated and preferred form, the elongate keyway 26 has a trapezoidal shape in cross-section with its corners rounded off. In the form shown in FIG. 16, the keyways 26 are of a half-trapezoidal shape with the keyways opening to the sides of the block bodies 16. It is also possible to provide the rear faces 32 of the block bodies 16 with similar elongate keyways 26 where the retaining wall 10 is to be visible from either side thereof, such as when used with commercial or residential buildings.

The elongate keyways 26 can be easily cast into the block bodies 16 as the block bodies 16 are formed in metal molds. One method for forming block bodies 16 as described in the Background utilizes molds which are designed to form a pair of attached block bodies 16 in a single mold which are then split to form two separate masonry blocks 12. Referring to FIGS. 19 and 20, to form keyways 26 in such a mold, metal mold inserts 34 can be inserted at either end of the mold to form the opposing rear faces 32 with such keyways 26 in a pair of block bodies 16 formed in the mold. To form the keyways 26 in the front faces 22 of the block bodies 16, a central metal mold insert 36 can be used between confronting front faces 22 of a pair of block bodies 16 formed simultaneously in one mold. In this manner, the block bodies 16 are not attached when formed in the mold as described above. As one skilled in the art will appreciate, a wide variety of other methods and molding systems can be used to form the block bodies 16.

To attach the decorative facing panels 14 to the block bodies 16 formed with the keyways 26 described herein, the facing panels are formed with a cooperating elongate locating member or tongue-key 38 which is sized to closely fit into the keyways 26 of the block bodies 16 so that when the keys 38 are slid into the keyways 26, the rear face 24 of the decorative panels 14 are flush against the front face 22 of the block bodies 16. To ensure a tight fit, the keys 38 have a cross-sectional shape that is complementary to the cross-sectional shape of the keyways 26 which can be a trapezoidal or half-trapezoidal shape, as previously described and illustrated in the Figures. Manifestly, a wide variety of other shapes can also be used such as round or hexagonal-shaped keys and keyways (not shown).

Figure 21:
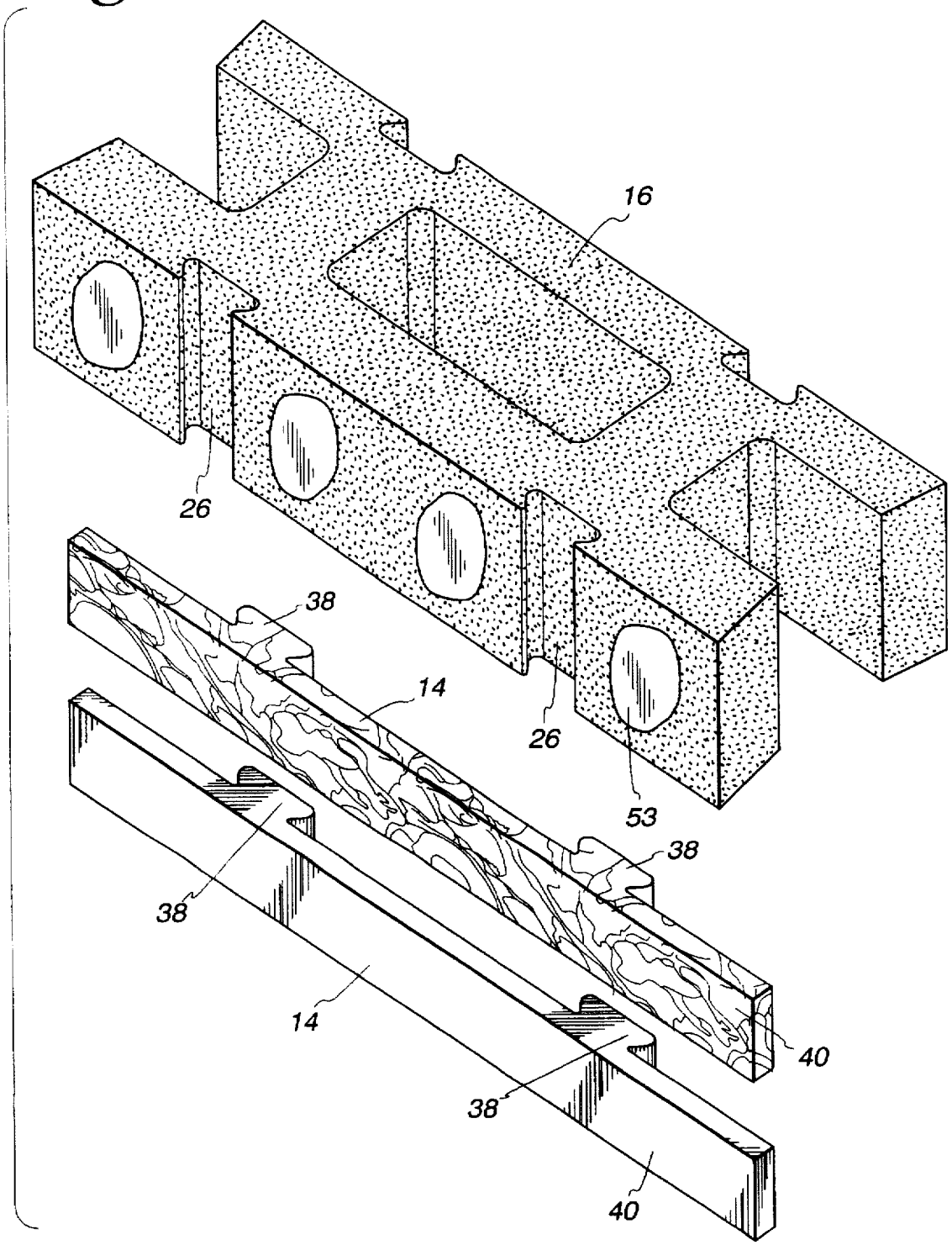
FIG. 21 is an exploded perspective view of the block of FIG. 3 and a pair of facing panels for attachment thereto.

The keys 38 as described above can be extruded from a metal or plastic material and then bonded to the rear face 24 of the decorative facing panels 14. Preferably, the keys 38 are cast or ground into the decorative facing panels 14 so as to be integral therewith, depending upon the material from which the facing panel is formed. As previously described, the facing panels can be formed from a wide variety of different materials so as to give the masonry blocks 12 a different outward appearance. So, for example, the facing panels 14 can be formed from more expensive marble, granite or metallic materials such as aluminum or bronze versus the lower cost masonry or concrete material used to make the block bodies 16. Other materials which can be used include plastics, glass, brick, tile and composites. A designer has a virtually unlimited selection of materials from which to choose for the decorative facing panels 14 so as to enhance the aesthetics of the masonry blocks 12 and/or to match a building exterior at a lower cost versus making the entire block 12 from the desired material used with the facing panel 14. It is also possible to use multiple facing panels 14 with a single block body 16, as illustrated in FIG. 21. In this manner, a combination of designs can be achieved on a single block body 16.

The facing panels 14 themselves can take on a wide variety of shapes and forms which can be used with a single type and shape of block body 16 having a keyway 26. This obviates the need to provide different molds for making block bodies of different shapes, thereby providing further flexibility of design without increasing the expense in the manufacture of the block bodies 16. The facing panels 14 as depicted in FIGS. 1–12 have a slightly curved front face 40. FIGS. 13–15 and FIG. 17 illustrate some of the other possible variations on the form of the front face 40. FIG. 13 shows an angled front face 40; FIG. 14 shows a fluted front face 40; FIG. 15 shows a front face 40 with a diamond-shaped raised portion 42; and FIG. 17 shows a flat face.

With the block units 18 formed from decorative facing panels 14 attached to masonry blocks 12 using the keyway interlock system 20 as described above, it is apparent that a wide variety of aesthetically appealing retaining walls 10 can be formed for lower costs than previously possible. A designer need not have the blocks which make up the retaining walls manufactured from the more expensive facing panel material and instead can utilize the smaller facing panels 14 with the blocks 12 made from the lower-cost masonry or concrete material, as described herein.

Figure 2:
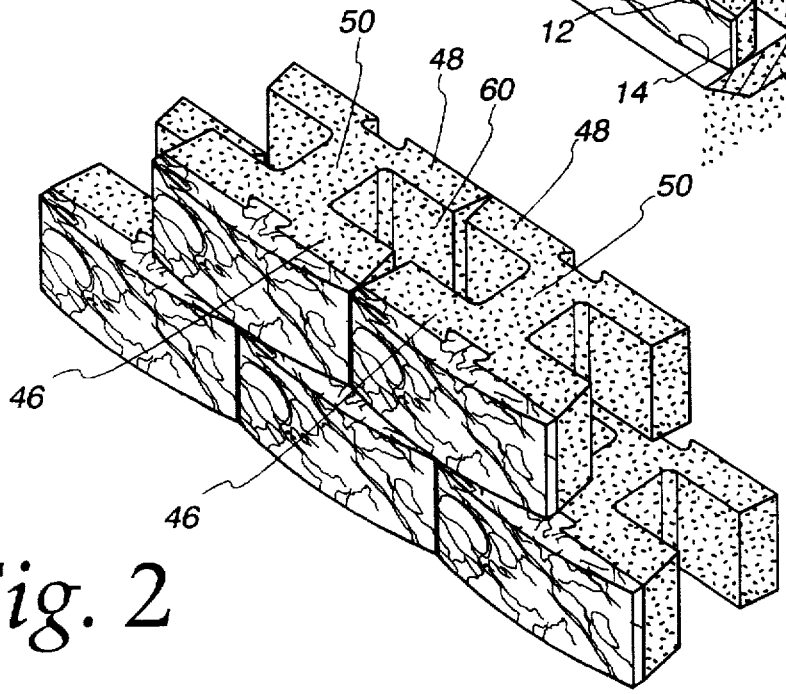
FIG. 2 is an enlarged perspective view of a portion of the wall of FIG. 1.
Figure 6:
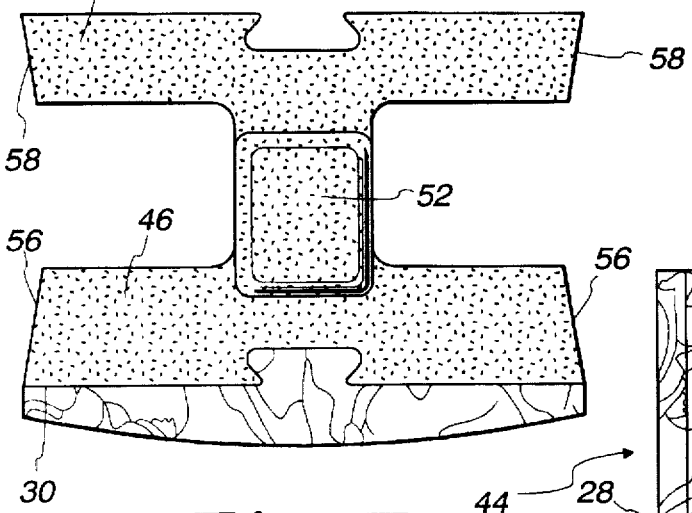
FIG. 6 is a bottom-plan view of the block and decorative panel of FIG. 3.
Figure 7:
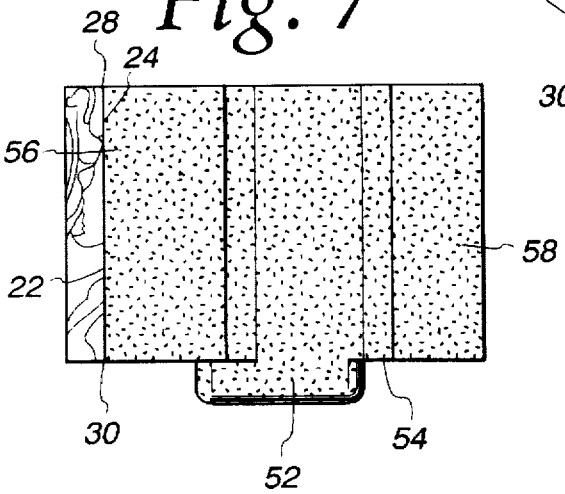
FIG. 7 is a side elevational view of the block and panel of FIG. 3.
Figure 8:
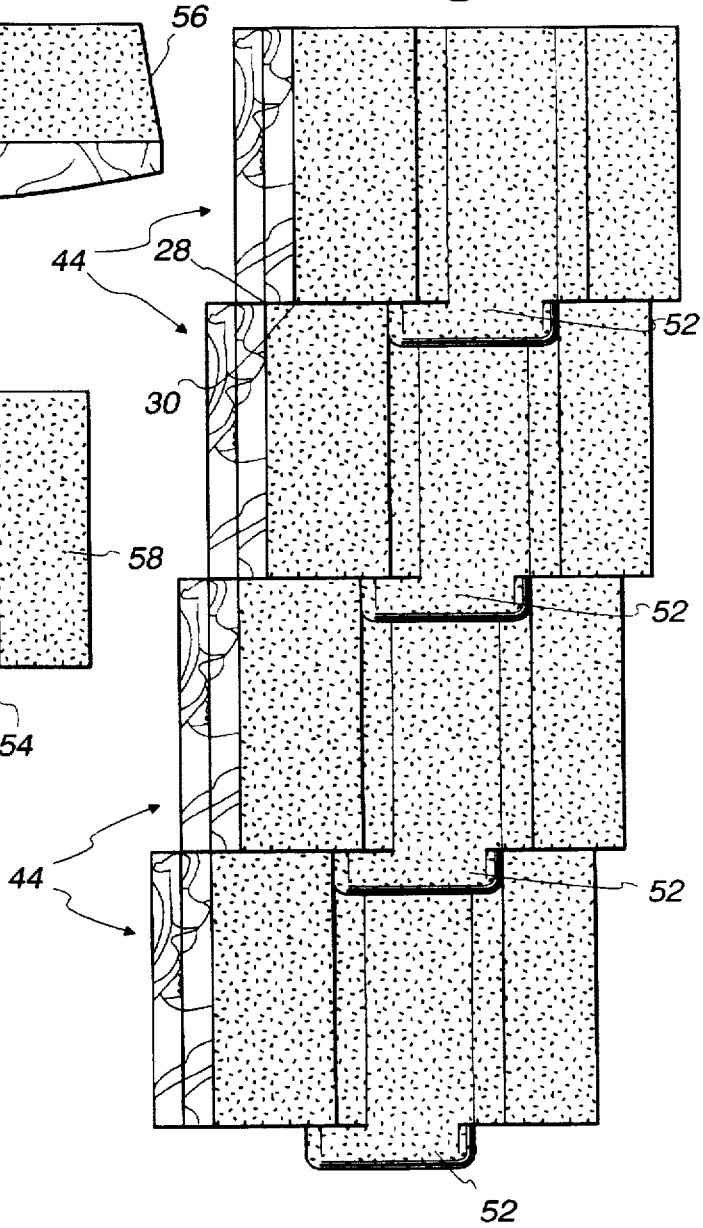
FIG. 8 is an enlarged side elevational view of a portion of the wall of FIG. 1 showing the set back relation of successive rows of blocks and panels.

By virtue of the blocks 12 and facing panels 14 being provided with cooperating keys 38 and keyways 26, the block units 18 can be quickly and easily assembled in the field at the site where the retaining wall 10 is to be erected. Preferably, the retaining wall 10 is built in offset rows 44 with each row being set back from the row below it. Referring to FIG. 1, the retaining walls 10 can be built by pouring a compacted road mix 45 on the surface on which the wall 10 is to be built. Thereafter, a bottom row 44 of masonry blocks 12 can be laid in side-by-side relation to one another on the road mix and, if soil 47 is being retained, preferably spaced forwardly from such soil by stones 49 between the wall and soil and having a 4"-diameter drain tile 51 placed near ground level for moisture run-off, as previously described. Next, successive rows 44 are laid in offset relation to each other as the rows progress upwardly such that each row is set back from the row below it, as best seen in FIG. 8. Further, the blocks in an upper row are placed on two adjoining blocks in a lower row so that the blocks 12 are in staggered relation to each other from one row to the next. Thus, the bottom edge 30 of the masonry blocks 12 rest on and are supported by a pair of adjacent lower row blocks, as best seen in FIG. 2.

In this manner, the entire retaining wall 10 initially can be built from the masonry blocks 12 with the decorative facing panels 14 being installed after the rows of masonry blocks 12 are set by sliding the keys 38 of the decorative facing panels 14 into the cooperating keyways 26 on their corresponding block bodies 16 such that the edge portion of the facing panels 14 at least partially rest on the masonry block bodies 16 therebelow to prevent the panel from sliding out of the keyway 26 of its corresponding block body. With the keyway interlock system 20, the panels can be easily removed and replaced if they are damaged or if changes in design are desired. It is also possible to permanently affix the decorative facing panels when the retaining wall 10 is being built, or at a later date if so desired, by applying an adhesive 53 to the front face 22 of the block body 16 as illustrated in FIGS. 3 and 21. The assignee of applicants herein has an adhesive product, SB-10 Paver Bond Adhesive, that is suitable for application to the masonry blocks 12 which cures and bonds the facing panels 14 thereto. As a safety measure, it may be desirable to use the SB-10 Adhesive between the top two layers of blocks and the top layer and any capping stone 55 used thereon, regardless of wall height. The adhesive made applied along the crack or top interface edge between the facing panel 14 and its associated masonry block to keep out water or moisture that could freeze and expand at the crack and break the block material.

The block bodies 16 may be cast in a wide variety of shapes. In one form, the block bodies 16 have a bottle-like shape, as illustrated in FIGS. 17 and 18. In a preferred form, the block bodies 16 are molded in an H-shape, as best seen in FIGS. 2–4, 6, 9, 16 and 19. Referring more specifically to FIGS. 2–4, the H-shaped block body 16 is defined by a pair of spaced legs 46 and 48 and a web 50 extending between the legs 46 and 48 intermediate thereof to form the H-shape for the block bodies 16.

To ensure a uniform set back from one row 44 to the next, the block bodies 16 can have a tab 52 projecting downwardly from the bottom 54 thereof, shown in FIGS. 5–8. The tab 52 fits into openings formed between adjacent blocks in the row therebelow such that the upper row block 16 can only be positioned forwardly to a point where its bottom edge 30 will be set back a predetermined distance from the top edge 28 of the blocks upon which it rests.

More specifically and referring to the H-shape blocks, the H-shaped blocks are placed in rows with corresponding ends 56 and 58 of each of the block legs 46 and 48 of adjacent blocks 12, respectively, abutting each other. In this manner, a pair of abutting masonry blocks 12 in a row 44 will form an opening 60 therebetween defined by the portions of the legs 46 and 48 extending from the web 50 towards the adjacent block 12, the adjacent block's corresponding leg portions 46 and 48 and the webs 50 of the two abutting blocks, as best seen in FIG. 2. The tab 52, as illustrated in FIGS. 5–8, has a substantially square cross-sectional shape and can be cast integrally with the block body 16 to project from the block bottom 54 under a portion of the web 50 and the forward leg 46. The tab 52 has a width corresponding to the width of the web 50 and has a length extending along the web 50 and the forward leg 46 corresponding to the length of the opening 60 between the two legs 46 and 48 such that the tabs 52 tightly fit lengthwise in the openings 60. With the tabs 52 inserted into the openings 60, blocks 12 in adjacent upper and lower rows are substantially fixed in a uniform off set relation to each other. Similarly, the tab 52 prevents the blocks 12 from being perfectly vertically aligned one on top of the other as the blocks must be vertically staggered by at least the width of the tab 52, and accordingly the web 50.

Figure 9:
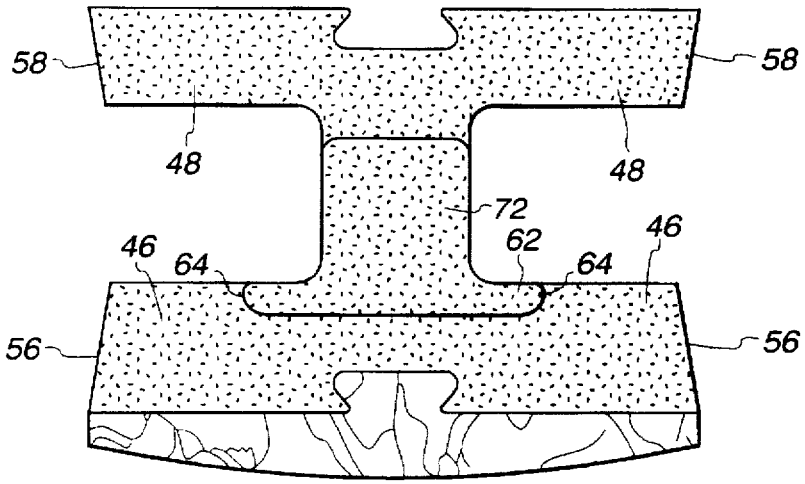
FIG. 9 is a bottom-plan view of the block of FIG. 3 having a modified T-shaped tab.
Figure 10:
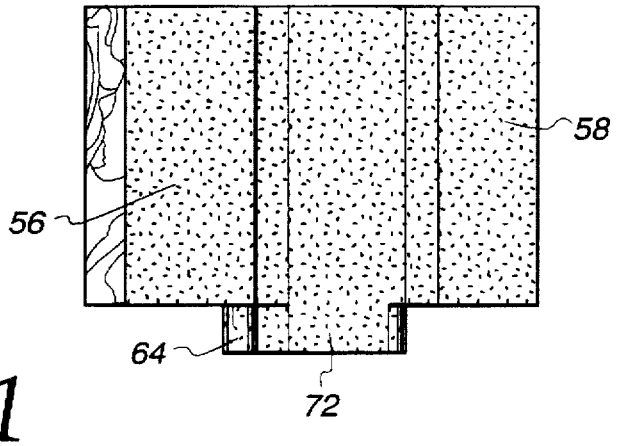
FIG. 10 is a side elevational view of the block and panel of FIG. 9.
Figure 11:
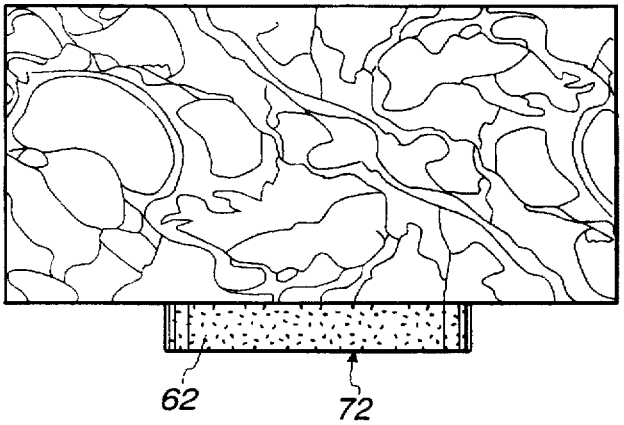
FIG. 11 is a front elevational view of the block and panel of FIG. 9.

In an alternative embodiment the tab has a T-shape in cross-section, as illustrated in FIGS. 9–11. The T-shaped locating tab 72 is similar to the tab 52 depicted in FIGS. 5–8, with the exception of the forward portion 62 under the forward leg 46 which is elongated to form the crossbar of the T. The elongated forward tab portion 62 provides a greater surface area for contacting the forward legs 46 of the lower blocks 12 when the tab 72 is inserted in the opening 60 between the lower blocks. In addition, the elongated tab portion 62 ensures a greater stagger between blocks in successive rows than the square shaped tab 52 depicted in FIGS. 5–8 because the forward elongated portion 62 gives the T-shaped tab 72 a greater effective width versus the square-shaped tab 52 with the ends 64 of the elongate tab portion 62 preventing the upper blocks 12 from being moved into vertical alignment over blocks in the row therebelow. With blocks utilizing either tabs 52 or 72, the bottom row of such blocks can be placed on the compacted road mix 45 when forming the retaining walls 10 so the tabs 52 or 72 will extend upward into holes 60 formed between abutting blocks in the row thereabove.

While the invention has been described with regards to its preferred embodiments, which constitute the best modes known to the inventor, it should be understood that various changes and modifications may be made without departing from the scope and spirit of the invention which is intended to be set forth in the claims appended hereto.

What is claimed is:

1. An outside masonry retaining wall for retaining earth and made with an outer decorative surface other than the masonry of the wall, comprising:

a plurality of rows of masonry blocks for retaining the earth and with the blocks each including a top edge and a bottom edge and a front face being made from a masonry material and having a masonry appearance extending between the top edge and the bottom edge, the blocks in an upper row being stacked upon the blocks in an adjacent lower row below the upper row with the bottom edges of the upper row blocks supported on adjacent lower row blocks;

the masonry blocks each having a unitary body formed with an integral front portion having the front face for facing outwardly toward the front of the retaining wall and having an exposed masonry surface;

the adjacent front portions of adjacent masonry blocks forming the front of the retaining wall;

a rearwardly extending web portion integrally joined to the integral front portion of each the unitary masonry blocks and extending rearwardly therefrom;

a rear leg portion integrally joined to the web portion and being spaced from the front portion by hollow spaces in each masonry block;

discrete and separate decorative facing panels substantially smaller in size than the masonry blocks and made of a decorative material selected from marble, granite, glass, tile or metal and having rear faces attached to the front faces of the masonry blocks to cover the exposed masonry surfaces of the front faces of the masonry blocks and to change the outward appearance of the front faces of the masonry blocks;

the decorative facing panels being made of different material than the masonry block material;

the decorative panels being substantially thinner in thickness than the blocks forming the retaining wall; and a keyway and key connection being formed in each the front faces of the blocks and rear faces of the decorative facing panels for mounting the decorative facing panels, respectively, flush against the front faces of the blocks to cover the masonry front faces of the masonry blocks to provide the outer decorative surface for the retaining wall.

2. The retaining wall of claim 1 wherein the keyway connection comprises a vertical keyway extending between the top and bottom edges of each of the blocks.

3. The retaining wall of claim 1 wherein the keyway connection comprises a plurality of keyways formed in each of the front faces of the blocks.

4. The retaining wall of claim 1 wherein the blocks each have a back face and a keyway is formed in the back faces of the blocks for mounting facing panels flush against the back faces of the blocks.

5. The retaining wall of claim 1 wherein the blocks are made from a concrete material.

6. The retaining wall of claim 1 wherein the facing panels have tongue keys which are sized to fit into the keyways on the blocks; and an adhesive is applied between the facing panels and the front faces of the blocks to secure the panels to their corresponding blocks.

7. A retaining wall comprising:

a plurality of rows of masonry blocks with the blocks each including a top edge and a bottom edge and a front face having a masonry appearance extending between the top edge and the bottom edge and the blocks in an upper row being stacked upon the blocks in an adjacent lower row below the upper row with the bottom edges of the upper row blocks supported on adjacent lower row blocks;

decorative facing panels substantially smaller in size than the masonry blocks having a rear face attached to the front face of each the masonry blocks to change the outward appearance of the front faces of the masonry blocks;

a keyway and key formed in the front faces of the blocks and rear faces of the decorative facing panels for mounting the decorative facing panels flush against the front faces of the blocks; and the blocks each include a top and a bottom with the bottom of the blocks each having a tab protruding therefrom and the blocks being configured to form openings between adjacent blocks in a row such that with the tabs of the upper blocks inserted in the openings between corresponding lower blocks the tabs and openings cooperate to substantially fix the stacked blocks in adjacent upper and lower rows in offset relation to each other.

8. A method for forming a masonry retaining wall for retaining earth and having an outer decorative surface providing an appearance of being other than being made of masonry material, the method comprising the steps of:

providing a plurality of masonry blocks made of masonry material having keyways with a first cross-sectional shape formed in their faces;

providing masonry blocks each having a unitary body formed with an integral front portion having the front face, the adjacent front portions of adjacent masonry blocks forming the front of the retaining wall, a rearwardly extending web portion integrally joined to the integral front portion of each the unitary masonry blocks and extending rearwardly therefrom, a rear leg portion integrally joined to the web portion and being spaced from the front portion by hollow spaces in each masonry block;

providing a plurality of decorative facing panels having elongate locating members with a second cross-sectional shape substantially the same as the first cross-sectional shape of the keyways, the decorative facing panels being made of different material than the masonry block material and made of a decorative material, the decorative panels being substantially thinner in thickness than the front block portions forming the outer sides of the retaining wall;

stacking the blocks in rows with each row being set upon the row below it to form a wall having a front side with outwardly exposed, front side, masonry surfaces and offsetting the masonry blocks in rows with each row offset from the row below it to engage and support a portion of a decorative panel on a masonry block thereabove; and after forming the masonry retaining wall, covering the outwardly exposed, front side, masonry surfaces of the masonry blocks by attaching the decorative facing panels to the blocks by sliding the locating members of the facing panels down into the keyways of the blocks; and resting portions of each lower edge of the decorative facing panel on portions of the offset block below it with the decorative panels flush against the front faces of the blocks to which they are attached to provide the previously formed masonry wall with the outer appearance of the decorative material of the decorative panels.

9. The method of claim 8 wherein the step of attaching the decorative facing panels further includes the step of applying adhesive to the blocks to fix the decorative facing panels to the blocks.

10. A method for forming a retaining wall, the method comprising the steps of:

providing a plurality of masonry blocks having keyways with a first cross-sectional shape formed in their faces;

providing a plurality of decorative facing panels having elongate locating members with a second cross-sectional shape substantially the same as the first cross-sectional shape of the keyways;

stacking the blocks in offset rows with each row being set back from the row below it; and attaching the decorative facing panels to the blocks by sliding the locating members of the facing panels down into the keyways of the blocks so that the facing panels rest on the blocks below it and are flush against the blocks to which they are attached; the blocks being provided with tabs and the step of stacking the blocks in offset rows includes the inserting of the tabs in openings formed between adjacent blocks immediately therebelow to produce a uniform set back from one row to the next.

11. A decorative retaining wall block for earth having an appearance on a front exterior side thereof of being other than being made of masonry material comprising:

a body made of a masonry material having the appearance of a masonry product on a front face of the block;

a first portion of a keyway interlock on the front face of the masonry body adjacent the front exterior side of the block;

a discrete-and separate decorative facing panel substantially smaller in size than the masonry body and made of a decorative material selected from marble, granite, glass, tile, or metal and attached to the front face of the masonry product to cover the exposed surface of the front face of the masonry body to change the outward face appearance of the block;

a second portion of the keyway interlock on the decorative facing panel to interlock the decorative facing panel to the masonry body;

the masonry block having a unitary body formed with an integral front portion having the front face for facing outwardly to the front of the retaining wall and having an exposed masonry surface until covered by the decorative facing panel;

a rearwardly extending web portion integrally joined to the integral front portion and extending rearwardly therefrom;

a rear leg portion integrally joined to the web portion and being spaced from the front portion by hollow spaces in the masonry block;

the decorative facing panel being made of different material than the masonry body material; and the decorative panel being substantially thinner in thickness than the block body.

12. The decorative retaining wall block of claim 11 wherein the first portion comprises an elongate keyway having a first cross-sectional shape and the second portion includes a tongue key having a second cross-sectional shape substantially the same as the first cross-sectional shape of the keyway.

13. The decorative retaining wall block of claim 12 wherein the keyway and key have complementary trapezoidal cross-sectional shapes.

14. A decorative retaining wall block comprising:

a body made of a masonry material having the appearance of a masonry product on a front face of the block;

a first portion of a keyway interlock on the front face of the masonry block;

a decorative facing panel substantially smaller in size than the masonry body attached to the front face of the masonry product to change the outward face appearance of the block;

a second portion of the keyway interlock on the decorative facing panel to interlock the decorative facing panel to the masonry body; and the block body having an H-shape in cross-section defined by a pair of spaced elongate legs spanned by an intermediate web with the block face and interlock first portion on at least one of the spaced legs, the web and one of the legs including a tab protruding from the bottom thereof which fits in openings formed between blocks immediately therebelow in a retaining wall with the ends of said legs abutting each other such that with blocks stacked in rows the tabs uniformly set back the blocks in one row from the row therebelow.

* * * * *

UNITED STATES PATENT AND TRADEMARK OFFICE

CERTIFICATE OF CORRECTION

PATENT NO. : 5,788,423
DATED : August 4, 1998
INVENTOR(S) : Perkins

It is certified that error appears in the above-indentified patent and that said Letters Patent is hereby corrected as shown below:

In the Title Page:

Line 22, change "Aug. 9, 1995" to --Sept. 8, 1995--.

Signed and Sealed this

Twelfth Day of September, 2000

*Attest:*

Q. TODD DICKINSON

*Attesting Officer*

*Director of Patents and Trademarks*